United States Patent [19]

Andersson et al.

[11] Patent Number: 4,546,940

[45] Date of Patent: Oct. 15, 1985

[54] PROJECTILE, ADAPTED TO BE GIVEN A ROTATION ON FIRING, WHICH MAKES THE PROJECTILE SPIN-STABILIZED

[76] Inventors: Kurt Andersson, Pudelgrand 10, S-123 62 Farsta; Nils Bartelsson, Furusundsgatan 12, S-115 37 Stockholm; Stig Bondesson, Olvontunet 10, S-181 48 Lidingo, all of Sweden

[21] Appl. No.: 570,423

[22] PCT Filed: Sep. 25, 1980

[86] PCT No.: PCT/SE80/00228

§ 371 Date: May 14, 1981

§ 102(e) Date: May 14, 1981

[87] PCT Pub. No.: WO81/00908

PCT Pub. Date: Apr. 2, 1981

Related U.S. Application Data

[63] Continuation of Ser. No. 269,039, May 14, 1981, abandoned.

[30] Foreign Application Priority Data

Sep. 27, 1979 [SE] Sweden ..... 7908002

[51] Int. Cl.[4] ..... F42B 13/32

[52] U.S. Cl. ..... 244/3.29; 244/3.1; 244/3.23

[58] Field of Search ..... 244/3.1, 3.23, 3.24, 244/3.27, 3.28, 3.29, 49, 138 A; 102/384, 385, 339, 348, 388, 400, 444, 445, 529, 703

[56] References Cited

U.S. PATENT DOCUMENTS

| | | | |
|---|---|---|---|
| 2,941,470 | 6/1960 | Jasse | 244/3.28 |
| 3,063,375 | 11/1962 | Hawley et al. | 244/3.29 |
| 3,103,886 | 9/1963 | Popenoe | 244/3.29 |
| 3,260,205 | 7/1966 | Dietrich | 244/3.23 |
| 3,415,467 | 12/1968 | Barringer | 244/3.29 |
| 3,603,533 | 9/1971 | Stripling | 244/3.23 |
| 3,790,103 | 2/1974 | Peoples | 244/3.23 |
| 3,899,953 | 8/1975 | Labruyere | 244/3.23 |
| 4,139,172 | 2/1979 | Miller et al. | 244/46 |
| 4,158,447 | 6/1979 | Humphries et al. | 244/3.27 |
| 4,203,569 | 5/1980 | Marks | 244/3.23 |
| 4,351,503 | 9/1982 | Drori | 244/3.24 |

FOREIGN PATENT DOCUMENTS

| | | | |
|---|---|---|---|
| 2143689 | 3/1973 | Fed. Rep. of Germany | 244/3.1 |
| 2721536 | 11/1978 | Fed. Rep. of Germany . | |

(List continued on next page.)

OTHER PUBLICATIONS

Appich, Jr. et al., "Wind Tunnel and Flight Test Drag Comparisons for a Guided Projectile with Cruciform Tails", AIAA Aerodynamic Testing Conference; 3/1980; pp. 375–382.

(List continued on next page.)

*Primary Examiner*—Charles T. Jordan

*Attorney, Agent, or Firm*—Fleit, Jacobson, Cohn & Price

[57] ABSTRACT

A projectile adapted to be given a rotation on being fired which makes the projectile spin-stabilized.

With the object of facilitating the terminal guidance of the projectile or increasing the effect of an explosive charge with a hollow-charge effect carried by the projectile, the projectile is provided with stabilizing fins (6–9) which are extended at a desired point in the trajectory of the projectile and brake the rotation of the projectile. The projectile is so dimensioned that its center of pressure (C2) is situated behind the center of gravity (G) of the projectile in the extended position of the fins (FIG. 2) and so that the center of pressure (C1) lies in front of the center of gravity of the projectile in the retracted position of the fins (FIG. 1), so that, with braked rotation, the projectile changes over from being spin-stabilized to being fin-stabilized.

The fins (6–9), which can consist of so-called wrap-around fins, are held in the retracted position, in an embodiment shown, by covering plates (2–5) which are held in place by a so-called base bleed unit (1). A delay device is adapted to be separated from the projectile at the desired point in the trajectory, so that the covering plates (2–5) are removed and expose the fins (6–9), as a result of which these can be extended.

8 Claims, 3 Drawing Figures

FOREIGN PATENT DOCUMENTS

| | | | |
|---|---|---|---|
| 819834 | 7/1937 | France . | |
| 1257614 | 2/1961 | France . | |
| 1485580 | 5/1967 | France . | |
| WO81/02926 | 8/1981 | PCT Int'l Appl. | 244/3.29 |
| 363892 | 2/1974 | Sweden . | |

OTHER PUBLICATIONS

Andersson, et al., "Common Geometry Smart Projectiles, Early Studies and Tests of a Concept"; 1984.

Appich, Jr. and Wittmeyer, Aerodynamic Effects of Body Slots on a Guided Projectile with Cruciform Surfaces, 17 J. Spacecraft 522 (Nov.–Dec. 1980), Presented as Paper 79–1658 at AIAA Atmospheric Flight Mechanics Conference, Aug. 6–8, 1979.

PROJECTILE, ADAPTED TO BE GIVEN A ROTATION ON FIRING, WHICH MAKES THE PROJECTILE SPIN-STABILIZED

This application is a continuation of application Ser. No. 269,039, filed May 14, 1981, now abandoned.

TECHNICAL FIELD

The present invention relates to a projectile adapted to be given a rotation on firing, which makes the projectile spin-stabilized. The invention can be used, in particular, as a terminally guided projectile and in general for projectiles which receive an explosive charge with a hollow-charge effect.

BACKGROUND ART

The development in the artillery field, both land and sea artillery, has rendered possible projectiles with an increased range of fire, for example by means of a so-called base bleed unit. The increased range of fire is naturally desirable but it leads to increased absolute dispersion of the projectiles. This increased dispersion is very unfavourable, all the more so as a change in the threat picture has become noticeable towards a greater frequency of smaller and harder elementary targets where each elementary target has to be combatted. In order to reduce the dispersion of the projectiles, terminal correction or terminal guidance of the projectiles has been proposed. This means that a projectile is fired in a ballistic trajectory in conventional manner but at the end of the trajectory a target-seeking member and guidance electronics are activated which can lead the projectile to a hit or near hit on the target. Compared with a radical exchange of tube artillery for missiles, a system with terminally corrected projectiles is less complicated than a robot because continuous guidance is not used. Moreover, the projectile is more difficult to intercept when it follows a ballistic trajectory for great or greater portion of the flight.

Different solutions to this problem have been introduced. Conventional artillery ammunition is spin-stabilized over the whole trajectory, that is to say it has a high speed of rotation (of the order of magnitude of 300–2000 rad/sec). Solutions to the problems of terminal guidance of projectiles which are spin-stabilized over the whole trajectory have been put forward. The advantages of such a system are that a completely conventional firing can be effected with ammunition effects which differ little in size and weight from conventional ammunition. The disadvantages are the very complicated guiding and the limited range of control as well as the very uncertain possibilities of realisation.

The target seeker is complicated and considerable difficulties arise in correcting the course since the roll position of the projectile must be determined when the guiding signal is given. It has been proposed that the roll direction should be determined in relation to a reference direction by means of the so-called rate-gyro and integration. This proposal is not without problems, however, because the gyro is sensitive to acceleration and can drift. With projectiles which are fired with a gun barrel, the sensitivity to acceleration is a particularly serious problem.

Thus a projectile which is spin-stabilized is altogether unsuitable for use as a terminally guided projectile or in general if the projectile is to receive for example an explosive charge with a hollow-charge effect where the explosive radiation is adversely affected if the explosive charge rotates.

An attempt to eliminate the disadvantages of a projectile which is spin-stabilized by discharging a useful load from the projectile is disclosed in the Swedish Patent Specification No. 363 892. There a projectile which is spin-stabilized is disclosed which is provided with brake flaps which, at the desired moment in the trajectory, are lowered and brake the rotation of the projectile so that the projectile becomes unstable, after which the useful load of the projectile is thrown away. Since such a projectile thus becomes unstable as a result of the braking of the rotation, it cannot serve as a terminally guided projectile or be provided with an explosive charge with a hollow-charge effect since that would require that the projectile should be aerodynamically stable.

The majority of solutions hitherto put forward for the problem of terminal guidance mean that the projectile is provided with so-called rotating driving bands which means that the projectile has a low speed of rotation (of the order of magnitude 0–200 rad/sec) when it leaves the muzzle. This means that stabilizing fins must be extended immediately outside the muzzle. The advantages of this system with low or no speed of rotation in the trajectory is that target seeking and guiding can be fairly simple. Certain warheads, such as explosive charges with a hollow-charge effect, require a low speed of rotation to give a good result, as mentioned above. The disadvantages of this system are that the range of firing is adversely affected. Moreover, the dispersion easily increases since the projectile is sensitive to disturbances at the beginning of the trajectory, that is to say when the fins are extended, and the extension of the fins easily introduces disturbances. Moreover, with the solutions hitherto proposed, the length of the projectile has greatly exceeded that which applies to conventional projectiles, which imposes new demands on the handling of ammunition particularly where automatic loading systems are concerned.

DISCLOSURE OF INVENTION

The present invention unites the advantages of the above system while at the same time the disadvantages are reduced to a minimum as a result of the fact that the projectile according to the invention is spin-stabilized when it is fired, after which, at a desired point in the trajectory of the projectile, the rotation is braked so that in the latter part of the projectile's trajectory, the projectile is fin-stabilized. This is achieved as a result of the fact that the projectile according to the invention is provided with stabilizing fins of the type which are known per se in fin-stabilized projectiles, wherein the fins are able to be extended from a retracted position on firing to an extended position at a desired point in the trajectory of the projectile and so to brake the rotation of the projectile, and wherein the projectile is so dimensioned that its aerodynamic centre of pressure in said extended position is situated behind the centre of gravity of the projectile, so that during braked rotation, the projectile changes over from being spin-stabilized to being fin-stabilized.

BRIEF DESCRIPTION OF DRAWINGS

The invention will be described in more detail below with reference to the accompanying drawings which show a preferred form of embodiment of a projectile according to the invention, in which in FIG. 1, the projectile, which is provided with a base bleed unit, is shown in the introductory phase of its trajectory, in FIG. 2 the same projectile is shown when the base bleed unit has been discarded and the fins exposed and in FIG. 3, the same projectile is shown when the optical system has been exposed and the nose rudder extended.

In the figures, the same parts have been provided with the same reference numerals throughout.

BEST MODE OF CARRYING OUT THE INVENTION

Figure 1:
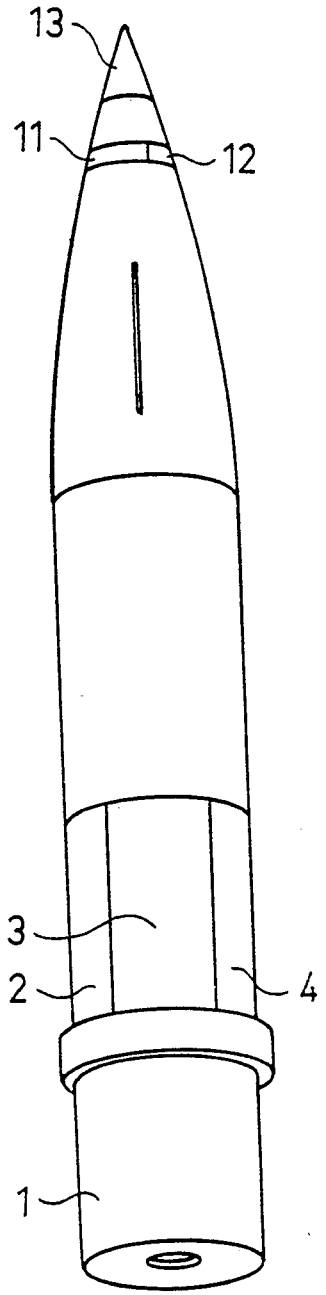
Figure 2:
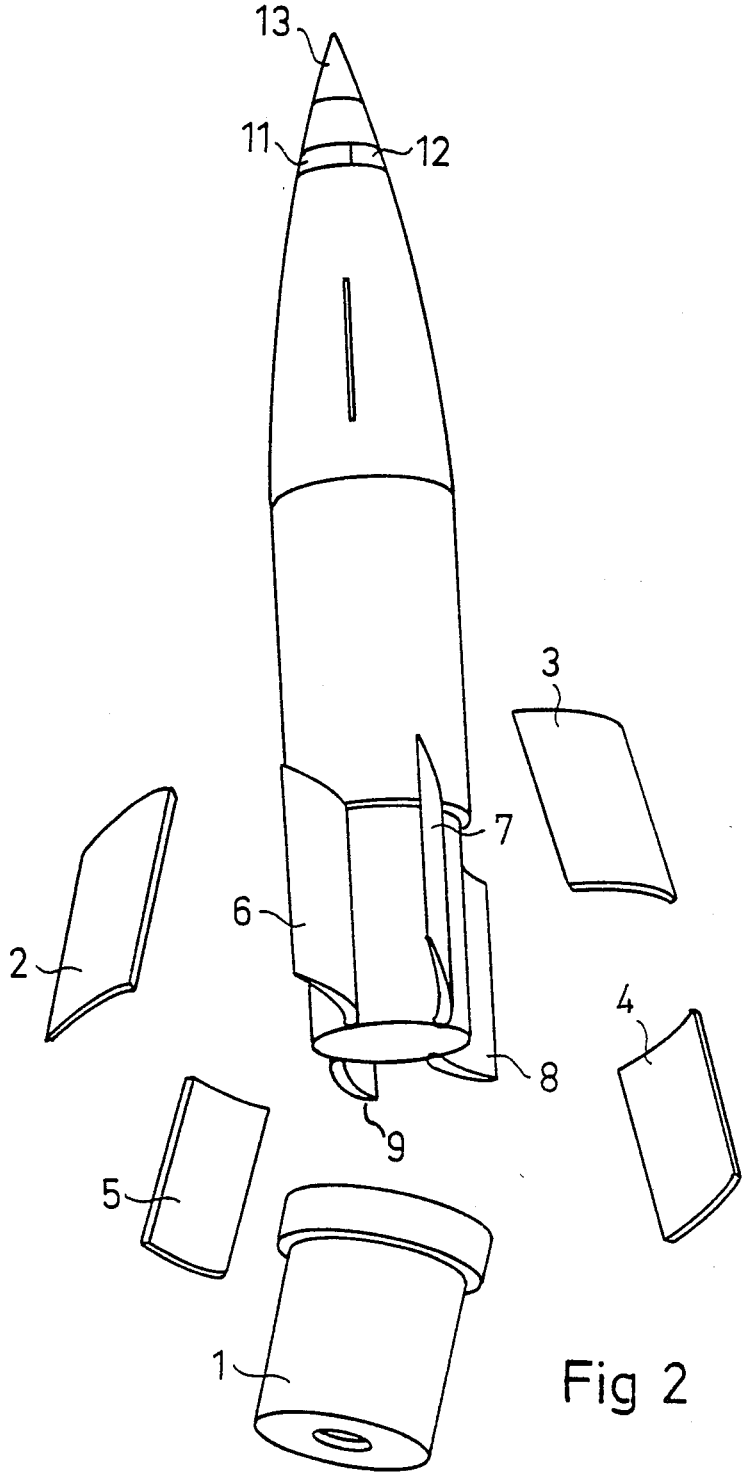

The projectile is shown with a base bleed unit 1 which gives an increased range of fire in known manner by giving off gas which increases the reduced pressure at the base end of the projectile. The need for end-phase correction increases, as stated earlier, with increased range of fire. It will be seen, however, that the present invention is suitable, to an equally high degree, for all other types of terminally corrected projectiles or for projectiles which carry an explosive charge with a hollow-charge effect.

In its back portion, the projectile is provided with four stabilizing fins 6–9 of the type which is known per se in fin-stabilized projectiles. In the embodiment shown they consist of so-called wrap-around fins, that is to say fins which, in the retracted position, largely follow the outer shell surface of the projectile. The fins 6–9 are held in the retracted position by means of locking members in the form of four conventional covering plates 2–5, which are held in place by the base bleed unit 1 as a result of the fact that this tightly surrounds the back portion of the covering plates.

A delay device, not shown, in the projectile is dimensioned so as to initiate, at a desired point of the trajectory, the throwing off of the base bleed unit 1 so that the covering plates 2–5 are automatically removed and expose the fins 6–9. These are so dimensioned, in known manner, that they extend through a combination of centrifugal forces and aerodynamic forces and afterwards, likewise in known manner, are locked in the extended position.

It will be seen that the arrangement of the covering plates 2–5 is not necessary and that these can be dispensed with if necessary.

The delay device which can contain a pyrotechnic charge, for example, is of conventional type well known to the expert so that it does not need to be shown or described here.

Several other methods of extending the fins 6–9 are naturally conceivable within the idea of the invention. Instead of swinging out, for example, they can be extended through gaps formed in the projectile.

In its front position, the projectile comprises four nose rudders 10 which can each be extended through its slot 10*a*, see FIG. 3, to guide the projectile in its later, fin-stabilized part of the projectile trajectory. The nose rudders 10 are adapted to be extended through the slots 10*a* when a predetermined braking of rotation is reached in the projectile. The initiation of the extension of the nose rudders may alternatively be effected by means of a delay device of conventional type, not shown. The guiding of the projectile can alternatively take place by means of pulses from one or more steering nozzles, in which case the nose rudders can be dispensed with entirely. If the projectile is provided instead with aerodynamic nose rudders, these can be extended during the whole trajectory time and even in the fire tube. This presupposes, however, that their span is less than the diameter of the barrel. The nose rudders then are so dimenionsed that the projectile can fly spin-stabilized.

Figure 3:
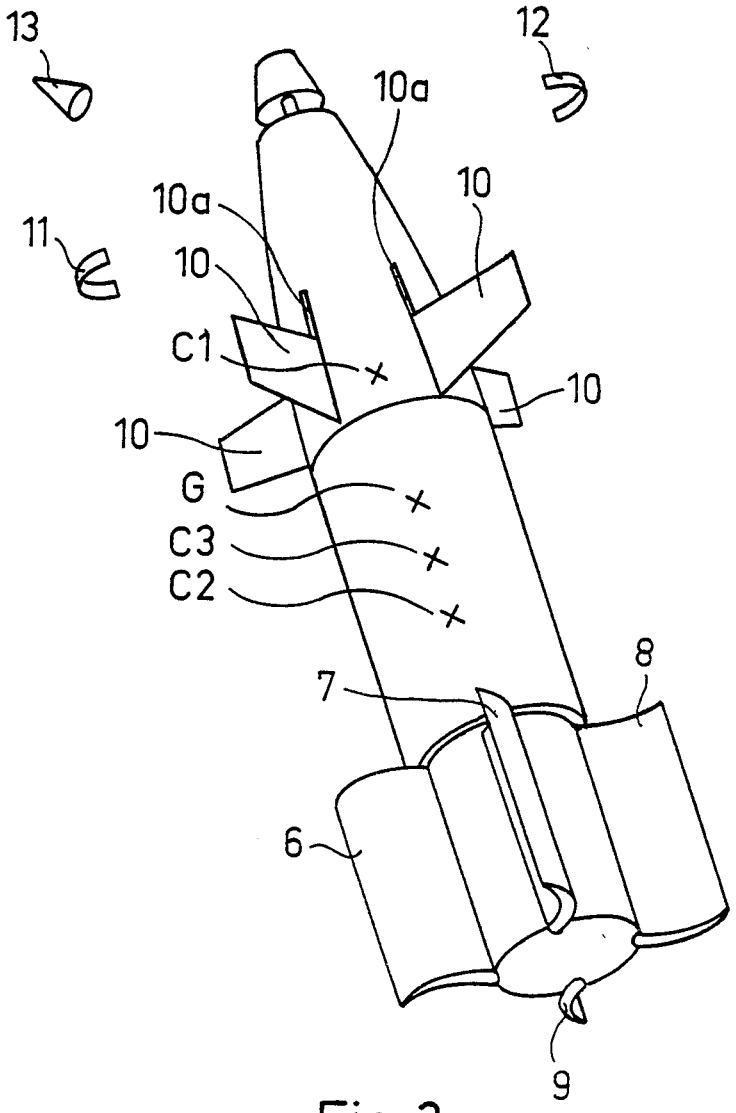

The projectile further comprises four covering plates 11–13 in a nose portion, which are adapted, through initiation by a delay device not shown, to be removed from the projectile after this has become fin-stabilized and to expose a target tracking optical system of the like, not shown, see FIG. 3.

Since neither the guidance system nor the target tracking optical system constitutes any part of the present invention, they are not shown or described here in detail but the above summary description of their operation is regarded as sufficient.

In order to achieve fin-stabilization of the spin-stabilized projectile, according to the invention, it requires on the one hand an arrangement of the stabilizing fins 6–9 in the manner described above, and on the other hand such a dimensioning of the projectile that its aerodynamic centre of pressure, that is to say the point where the air forces act, are situated behind the centre of gravity of the projectile in the extended position of the fins. The projectile is further so dimensioned that its centre of pressure also lies behind the centre of gravity of the projectile when both the fins 6–9 and the nose rudders 10 are extended. Finally, the projectile is so dimensioned that its centre of pressure lies somewhat in front of the centre of gravity of the projectile when the fins 6–9 and the nose rudders 10 are in the retracted position, that is to say in the first part of the trajectory of the projectile, when the projectile is spin-stabilized. Although for spin-stabilized projectiles in general, it applies that the centre of pressure should lie in front of the centre of gravity in this manner, it is nevertheless conceivable, within the scope of the invention, to position the centre of pressure in or behind the centre of gravity of the projectile instead.

The positioning of the centre of pressure is shown in FIG. 3 where the centre of pressure, in the retracted position of the fins 6–9, is situated at a point C1, which lies somewhat in front of the centre of gravity of the projectile, which is marked by G in FIG. 3. In the extended position of the fins 6–9, the centre of pressure is shifted back to a point C2 behind the centre of gravity G. On extension of the nose rudders 10, the centre of pressure is shifted forwards somewhat to a point C3 which nevertheless also lies behind the centre of gravity G.

The mode of operation of the projectile described is as follows: When the projectile is fired from a barrel not shown, it is given a relatively high speed of rotation (of the order of magnitude of 300–2000 rad/sec), for example by means of conventional projectile driving bands. At a predetermined, desired point in the trajectory of the projectile the base bleed unit 1 is thrown away so that the covering plates 2–5 are removed and the fins 6–9 exposed. These are extended and brake the rotation of the projectile. As a result of the above-mentioned dimensioning of the fins and the projectile, the projectile changes over from being spin-stabilized to being fin-stabilized. The terminal guidance and target-seeking function of the projectile or the triggering of the explosive charge of the projectile with a hollow-charge effect can now take place.

With a view to precision and range, it is usually best to extend the fins after at least half the trajectory has been covered but in certain cases an earlier extension can be advisable so as to obtain a low speed of rotation in time.

We claim:

1. A guided projectile system for firing a projectile from a barrel and guiding the projectile through its trajectory, said guided projectile system comprising:

rotating means for firing said projectile from said barrel and for rotating said projectile at a spin rate in the range of 300–2000 rad/sec to enable said projectile to be in a stabilized state in its trajectory solely by rotating motion, said projectile travelling at least half of its trajectory outside the barrel in said stabilized state;

said projectile including stabilizing fins located in a retracted position during said stabilized state and being extendable to an extended position at a desired point in the trajectory of said projectile to thereby brake rotation of said projectile;

said projectile having an aerodynamic center of pressure located in front of the center of gravity of said projectile when said stabilizing fins are in said retracted position, and the aerodynamic center of pressure of said projectile being moved, when said stabilizing fins are in said extended position, to be located behind the center of gravity of said projectile for stabilization of said projectile; and said projectile, upon extension of said stabilizing fins to said extended position for braked rotation of said projectile, changing over from being stabilized solely by rotating motion to being fin-stabilized by said stabilizing fins shifting said aerodynamic center of pressure to be located behind the center of gravity and said projectile.

2. A guided projectile system as claimed in claim 1, further comprising locking means for holding said stabilizing fins in said retracted position, said locking means being separable from said projectile to expose said stabilizing fins at said desired point in the trajectory.

3. A guided projectile system as claimed in claim 1, wherein said stabilizing fins are formed as wrap-around fins.

4. A guided projectile system as claimed in claim 2, wherein said stabilizing fins are formed as wrap-around fins.

5. A projectile comprising:

a projectile body being rotatable in the range of 300–2000 rad/sec during at least half of its trajectory for stabilization of said projectile body solely by rotation;

stabilizing fins located in a retracted position on said projectile body during said at least half of the projectile body's trajectory and said stabilizing fins moving to an extended position at a desired point in the trajectory of said projectile body to brake rotation of said projectile; and an aerodynamic center of pressure of said projectile body being located in front of the center of gravity of said projectile body during said at least half of the projectile body's trajectory and said aerodynamic center of pressure being moved behind said center of gravity for stabilization of said projectile upon extension of said stabilizing fins to said extended position and for changing stabilization of said projectile body from stabilization solely by rotation to stabilization by said stabilizing fins.

6. A projectile as claimed in claim 5, further comprising locking means for holding said stabilizing fins in said retracted position, said locking means being separable from said projectile to expose said stabilizing fins at said desired point in the trajectory.

7. A projectile as claimed in claim 6, wherein said stabilizing fins are formed as wrap-around fins.

8. A projectile as claimed in claim 5, further comprising a base bleed unit mounted at the base end of the projectile body.

* * * * *